US005901499A

United States Patent [19]

Delaske et al.

[11] Patent Number: 5,901,499

[45] Date of Patent: May 11, 1999

[54] DOUBLE-HUNG WINDOW LOCKING SYSTEM

[75] Inventors: Robbin J. Delaske, Waterville; Stephen O. Myers, Prior Lake; Joseph P. Landherr, Rose Creek, all of Minn.

[73] Assignee: Truth Hardware Corporation, Owatonna, Minn.

[21] Appl. No.: 08/862,769

[22] Filed: May 23, 1997

[51] Int. Cl.[6] ..... E05D 15/22

[52] U.S. Cl. ..... 49/183; 49/460; 49/181; 49/445; 16/193

[58] Field of Search ..... 49/176, 181, 183, 49/445, 447; 16/193, 200

[56] References Cited

U.S. PATENT DOCUMENTS

| | | | |
|---|---|---|---|
| 3,611,636 | 10/1971 | Trout | 49/181 |
| 4,922,657 | 5/1990 | Foss . | |
| 5,440,837 | 8/1995 | Piltingsrud . | |
| 5,448,857 | 9/1995 | Stormo . | |
| 5,572,828 | 11/1996 | Westfall | 49/181 |

*Primary Examiner*—Daniel P. Stodola
*Assistant Examiner*—Hugh B. Thompson
*Attorney, Agent, or Firm*—Wood, Phillips, VanSanten, Clark & Mortimer

[57] ABSTRACT

A locking assembly for a double-hung window assembly having a pair of vertical jamb liners, including a shoe slidable in a channel in one liner and operably connected to a sash for sliding movement therewith. A first locking member is rotatably connected to the first shoe, and manually operable means is pivotably connected to the shoe and operatively engageable with the first locking member for effectuating pivoting movement of the first locking member between (a) a limiting position wherein the first locking member engages one side wall of the one slide channel and (b) a releasing position wherein the first locking member is disengaged from the side wall of the slide channel. The first locking member including at least one tooth which engages and grips the side wall of the slide channel with the first locking member in the limiting position. A detent releasably maintains the first locking member in at least one of the limiting position and the releasing position.

29 Claims, 5 Drawing Sheets

DOUBLE-HUNG WINDOW LOCKING SYSTEM

FIELD OF THE INVENTION

The present invention is directed toward a window locking system and, more particularly, toward a locking system for double-hung window assemblies.

BACKGROUND OF THE INVENTION

Double-hung window assemblies are well known in the art and generally include a pair of window sashes slidably mounted in a frame. The window sashes are generally movable in parallel planar paths whereby the window opening may be half opened by moving one sash into an overlapping position with the other sash. In normal operation, the lower inner sash, which is the sash moving in the path closest to the interior of the room, is raised and lowered, while the outer sash is generally secured at the upper end of its path. Preferably, the lower sash is capable of being tilted in toward the room area so that the outer surface of its pane may be reached from the interior of the room for washing.

Locking is generally provided by cam locks, such as check rail locks in which the two sashes are mechanically secured to one another when in the closed non-overlapping position to prevent movement relative to one another. These locks are generally required to be disposed on top of the lower sash, which in some installations can be difficult to reach if the window sashes are tall or if the windows are located higher on the wall than normal. Such locks are also susceptible to breaking when subjected to force due to the entire locking occurring at the particular area of the lock. Accordingly, if a potential intruder applies force to the window, the entry force is resisted solely at the point where the sash lock is secured to the sash. Breaking of the lock, or possibly the wooden or PVC sash is a distinct possibility due to the resulting stress concentrations at the lock location.

Further, since locks of the above-described type are generally disposed on top of the inner sash at the middle of the window opening, they can be an undesirable visual intrusion on the view through the window.

Counterbalancing weights or compensating springs are also generally used with the sashes of double-hung window assemblies to aid in raising such sashes. The sashes are typically held in open venting positions by a combination of the counterbalancing weights, or springs, and a frictional-type binding of the sash in its track. Unfortunately, such binding also occurs when moving the sash to thereby increase the effort required to open and close the window. Accordingly, a design balance is required to minimize binding for ease of operation while still maintaining sufficient binding to prevent the sash from falling closed and possibly injuring a person, and more particularly a child, who might have their hands or head in the opening. Of course, even a proper initial design balance will often fail over time, as evidenced by the not uncommon occurrence of older windows which are often times kept open only be wedging something such as a board beneath the sash.

Placing the window sash in an open venting position also requires that the lock be in an unlocked position to permit planar movement of the inner sash relative to the outer sash. As a result, the vented window becomes a security hazard whereby a potential burglar can readily recognize that the window is unlocked and easily raise the sash and gain access to the house.

The present invention is directed toward overcoming one or more of the problems set forth above.

SUMMARY OF THE INVENTION

In one aspect of the present invention, a locking assembly is provided for use in a double-hung window assembly having at least one sash slidably movable in the window frame, the window frame including a pair of vertical jamb liners secured thereto with each jamb liner defining a vertical slide channel having opposing side walls, and means connected to the frame for urging the one sash toward a raised position, the locking assembly including a first shoe received in one slide channel for vertical sliding movement therein and operably connected to the one sash for sliding movement therewith, and means operably connected to the first shoe and selectively engageable with one of the side walls in the one slide channel for limiting sliding movement of the one sash in a raised direction.

In another aspect of the present invention, the limiting means includes a first locking member rotatably connected to the first shoe, and manually operable means pivotably connected to the first shoe and operatively engageable with the first locking member for effectuating pivoting movement of the first locking member between (a) a limiting position wherein the first locking member engages the one side wall of the one slide channel and (b) a releasing position wherein the first locking member is disengaged from the one side wall of the slide channel.

In another aspect of the present invention, the first locking member, in its limiting position, secures the one sash only against movement in the raised direction.

In another aspect of the present invention, the first locking member is pivotable to its limiting position at an infinite number of positions along the one slide channel.

In another aspect of the present invention, the first locking member includes at least one tooth engaging and gripping the one side wall of the one slide channel with the first locking member in the limiting position.

In another aspect of the present invention, the first locking member includes a pair of side plates rotatably mounted on opposite sides of the first shoe, and a connecting plate between the side plates and disposed in a first recess formed in the first shoe, with each side plate including a tooth for engaging and gripping the one side wall of the one slide channel with the first locking member in the limiting position.

In another aspect of the present invention, the manually operable means includes a lock plate pivotally attached to the first shoe and operatively engageable with the first locking member, and a handle extending from the lock plate and accessible to a user, wherein pivoting the handle effects pivotal movement of the first locking member via the lock plate.

In another aspect of the present invention, the lock plate includes a first elongate slot and the first locking member includes a first finger extending from one of the side plates and received in the first elongate slot, wherein pivotal movement of the lock plate causes the first finger to move along the first elongate slot thereby effecting pivoting movement of the first locking member.

In another aspect of the present invention, a detent means is included for releasably maintaining the first locking member in at least one of the limiting position and the releasing position.

In another aspect of the present invention, the detent means includes a projection on one of the side plates of the first locking member and a corresponding recess in the lock plate, wherein the projection is releasably frictionally maintained in the recess with the first locking member in one of the limiting position and the releasing position.

In another aspect of the present invention, a second locking member is rotatably mounted to the first shoe and operatively engageable with the lock plate, the second locking being pivotable between limiting and releasing positions in conjunction with the first locking member.

In another aspect of the present invention, the second locking member includes a pair of side plates rotatably mounted on opposite sides of the first shoe, and a connecting plate between the side plates and disposed in a second recess formed in the first shoe, with each side plate including a tooth engaging and gripping one of the side walls of the one slide channel with the second locking member in the limiting position.

In another aspect of the present invention, the lock plate includes a second elongate slot and the second locking member includes a second finger extending from one of the side plates and received in the second elongate slot, wherein pivotal movement of the lock plate causes the second finger to move along the second elongate slot thereby effecting pivotal movement of the second locking member.

In still another aspect of the present invention, the one sash is restrained from sliding movement in the raised direction with the first and second locking members in the limiting position, and sliding movement of the one sash is permitted in both raised and lowered directions with the first and second locking members in the releasing position.

In yet another aspect of the present invention, a pair of pivot shafts and a second shoe are provided, the pair of pivot shafts secured to opposite sides of the one sash defining a horizontal axis for tilting movement of the one sash relative to the frame, and the second shoe received in the other slide channel for vertical sliding movement therein, the first and second shoes each being connected to one of the pivot shafts and at least one connected to the urging means.

It is an object of the invention to provide a structure permitting easy and inexpensive mounting of a double-hung window.

It is another object of the invention to provide a double-hung window in which the sash may be easily removed for maintenance and/or tilted for washing.

It is another object of the invention to provide a double-hung window which may be easily operated without bonding when opening and closing the sash.

It is another object of the invention to provide a double-hung window which may be easily and securely locked with minimal manual force.

Still another object of the invention is to provide a double-hung window which may easily and securely locked not only in the closed position but also in an infinite number of open venting positions.

Yet another object of the present invention is to provide a double-hung window which is aesthetically pleasing with minimal visual intrusion through the window opening by the locking hardware.

Other aspects, objects and advantages of the present invention can be obtained from a study of the application, the drawings, and the appended claims.

DETAILED DESCRIPTION OF THE PREFERRED EMBODIMENT

Figure 1:
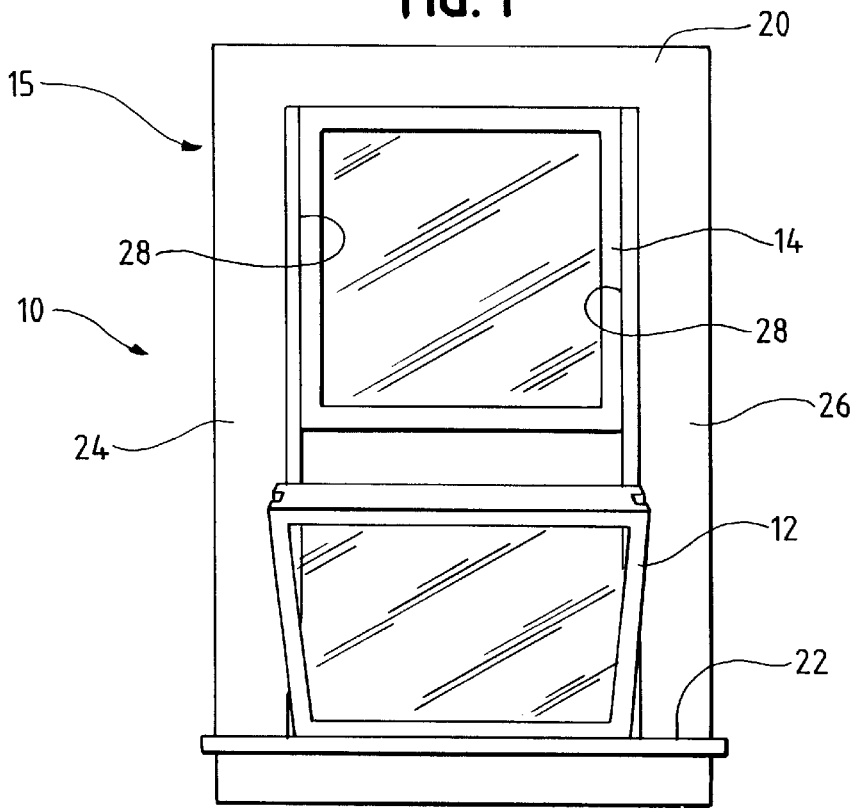
FIG. 1 is a perspective view showing a double-hung window assembly mounted in an exterior wall with one of the vertically slidable sashes being tilted inwardly about a horizontal axis to a wash position.
Figure 2:
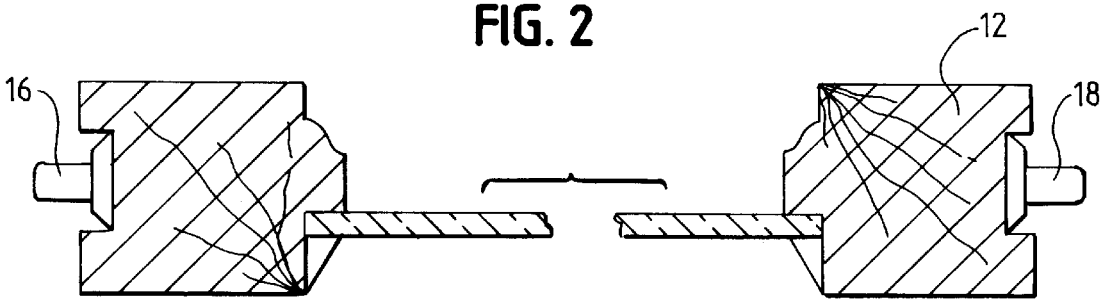
FIG. 2 is a sectional view of the lower sash of the double-hung window assembly of FIG. 1, illustrating the location of the pivot pins.

Referring more particularly to the drawings, FIG. 1 depicts a double-hung window assembly 10 with a pair of sliding sashes including a lower sash 12 and an upper sash 14 which are generally movable in parallel planar paths within frame 15. The sashes 12, 14 not only slide between open and closed positions in the window frame 15, but also are adapted to pivot inwardly relative to the frame 15. For example, FIG. 1 depicts the lower sash 12 pivoted inwardly about a horizontal axis defined by a pair of pivot pins 16 and 18 (see FIG. 2) extending outwardly from the lower portion of the lower sash 12. The sashes 12, 14 are mounted in a window frame that includes a header 20, a sill 22, and a pair of vertical jambs 24, 26.

Figure 3:
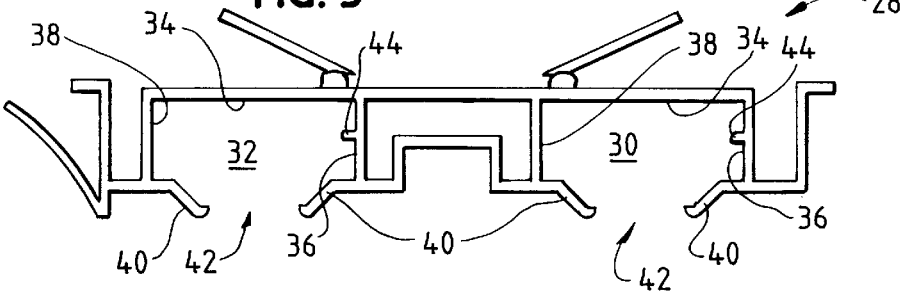
FIG. 3 is a top view of one of the jamb liners of the double-hung window assembly of FIG. 1.
Figure 4:
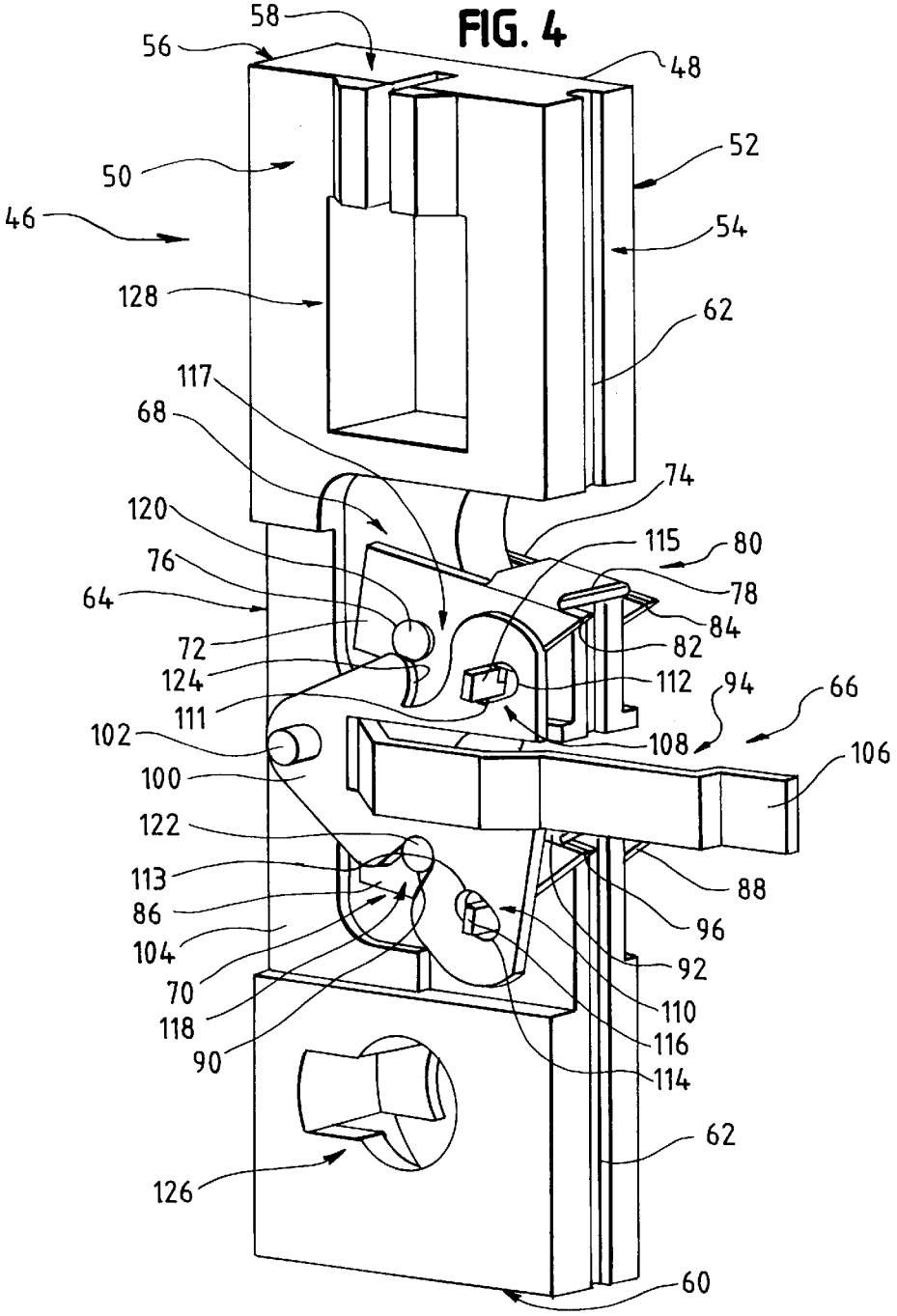
FIG. 4 is a perspective view of a locking assembly according to the present invention in a limiting or locking position.
Figure 5:
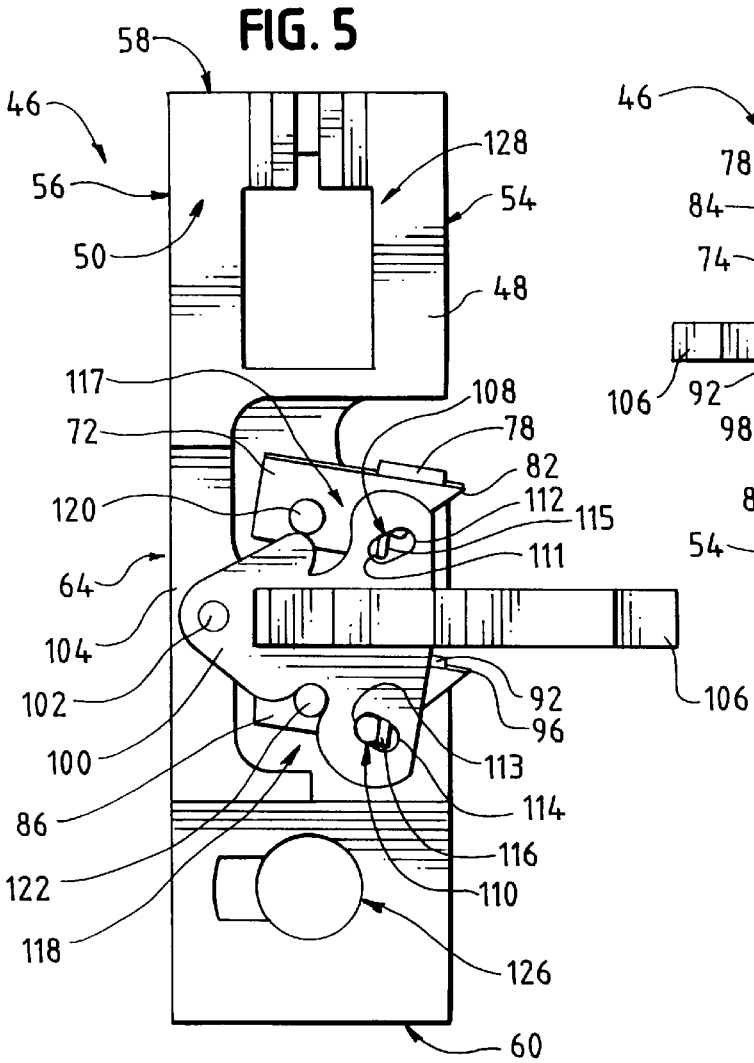
FIG. 5 is a front view of the locking assembly shown in FIG. 4.
Figure 6:
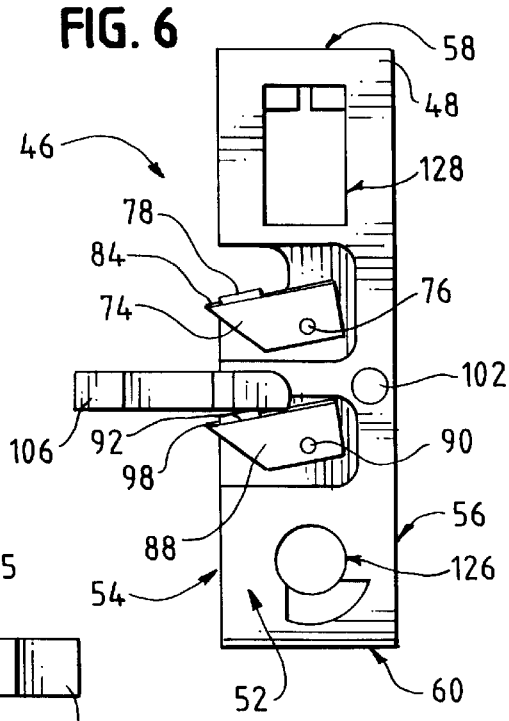
FIG. 6 is a rear view of the locking assembly shown in FIG. 4.
Figure 7:
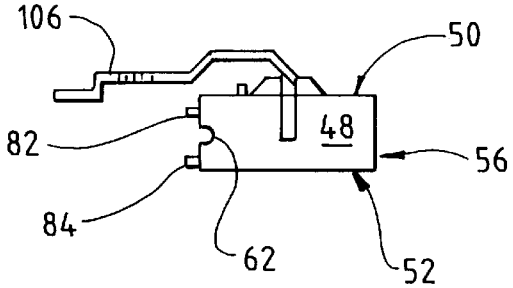
FIG. 7 is a top view of the locking assembly shown in FIG. 4.

In accordance with the present invention, each jamb 24, 26 is provided with a jamb liner 28 (top view of one shown in FIG. 3) preferably made of vinyl or other similar material. Each jamb liner 28 includes a pair of vertical slide channels 30, 32 formed therein. Each channel 30, 32 is defined by a side wall 34 that is in a plane parallel to the side face of the jamb 24, 26, a forward wall 36 perpendicular to the side wall 34, and a rear wall 38 also perpendicular to the side wall 34 and parallel to the forward wall 36. Extending from the inner ends of the respective walls 36, 38 are flanges 40 which define a vertical opening 42 in each channel 30, 32, and serve as guides for the sashes 12, 14.

Each channel 30, 32 has an inwardly extending rib 44 formed therein that extends from the forward wall 36 parallel to the side wall 34. The rib 44 cooperates with the locking assembly of the present invention in a manner which will be described hereinafter.

Referring now to FIGS. 4–9, a locking assembly in accordance with the present invention is shown generally at 46. The locking assembly 46 includes a shoe 48 receivable in one of the vertical slide channels 30, 32. The shoe 48 includes an outer face 50, an inner face 52 that abuts against the side wall 34 of the respective channel 30, 32, a side face 54 that abuts against the forward channel wall 36, and an opposite side face 56 that abuts against the rearward channel wall 38. Also, the shoe 48 has a top face 58 and a bottom face 60, and is preferably formed of a low-friction plastic or other similar material.

A longitudinal groove 62 is formed in the side face 54 of the shoe 48 and extends the entire length thereof. As shown more particularly in FIG. 9, the groove 62 receives the rib 44 when the shoe 48 is mounted for sliding movement within one of the channels 30, 32.

The shoe 48 includes a recessed middle section 64 which includes recesses formed on both the outer and inner faces 50, 52 of the shoe 48. A locking structure, shown generally at 66, is mounted to the shoe 48 at this middle recessed portion 64.

The locking structure 66 includes first and second locking members 68, 70 pivotally mounted to the shoe 48. The first locking member 68 includes first and second side plates 72, 74 rotatably attached on opposite sides of the shoe 48 via a rivet 76. The first and second side plates 72, 74 are preferably made of stainless steel and are substantially parallel with the outer and inner faces 50, 52 of the shoe 48 and are connected by a cross piece 78 which is disposed in a first recess 80 formed in the side face 54 of the shoe 48. Each side plate 72, 74 terminates in a sharp tooth portion 82, 84, respectively.

Figure 8:
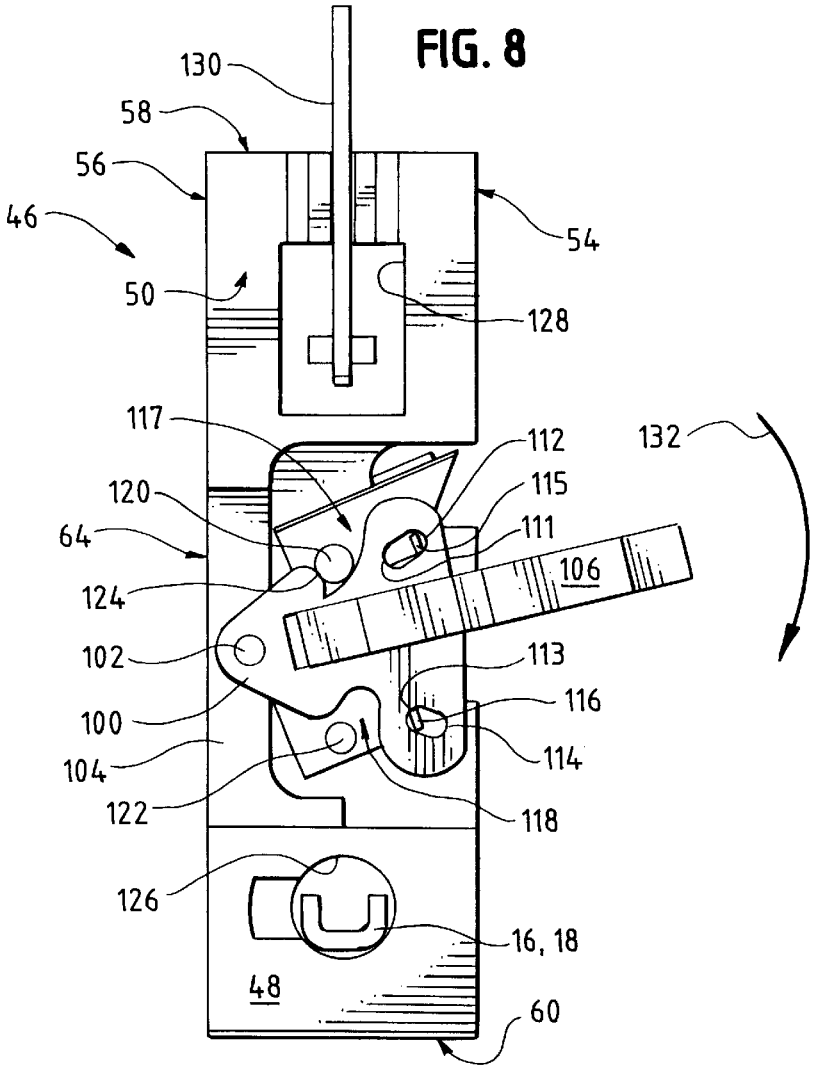
FIG. 8 is a front view of the locking assembly in its releasing position and depicting operable connection thereof to a pivot pin on the sash and a counterbalancing means on the frame.

The first locking member 68 is pivotable between a limiting position, as shown in FIGS. 4–7, where the tooth portions 82, 84 of the first and second side plates 72, 74 of the first locking member 68 extend forward of the side face 54 of the shoe 48, and a second releasing position, as shown more particularly in FIG. 8, where the tooth portions 82, 84 are disposed within the recess 80.

Similarly, the second locking member 70 includes first and second side plates 86, 88 rotatably attached on opposite sides of the shoe 48 via a rivet 90. The first and second side plates 86, 88 are also preferably made of stainless steel and are also substantially parallel with the outer and inner faces 50, 52 of the shoe 48 and are connected by a cross piece 92 which is disposed in a second recess 94 formed in the side face 54 of the shoe 48. Each side plate 86, 88 terminates in a sharp tooth portion 96, 98, respectively.

The second locking member 70 is also pivotable between a limiting position, as shown in FIGS. 4–7, where the tooth portions 96, 98 of the first and second side plates 86, 88 of the second locking member 70 extend forward of the side face 54 of the shoe 48, and a second releasing position, as shown more particularly in FIG. 8, where the tooth portions 96, 98 are disposed within the recess 94.

Synchronous pivoting of the first and second locking members 68, 70 is effectuated by a lock plate 100 pivotally attached to the shoe 48 at the middle of recessed portion 64 by a rivet 102. More specifically, the lock plate 100 is pivotally mounted to the shoe 48 at a raised shoulder portion 104 so that the lock plate 100 is in overlapping relationship with the first and second locking members 68, 70, while not extending past the outer face 50 of the shoe 48, as shown more particularly in FIG. 7. The lock plate 100 is shown as having a generally triangular shape and mounted to the shoe 48 at one of its apexes, however, it should be understood that the lock plate 100 may encompass a variety of geometric configurations.

Figure 9:
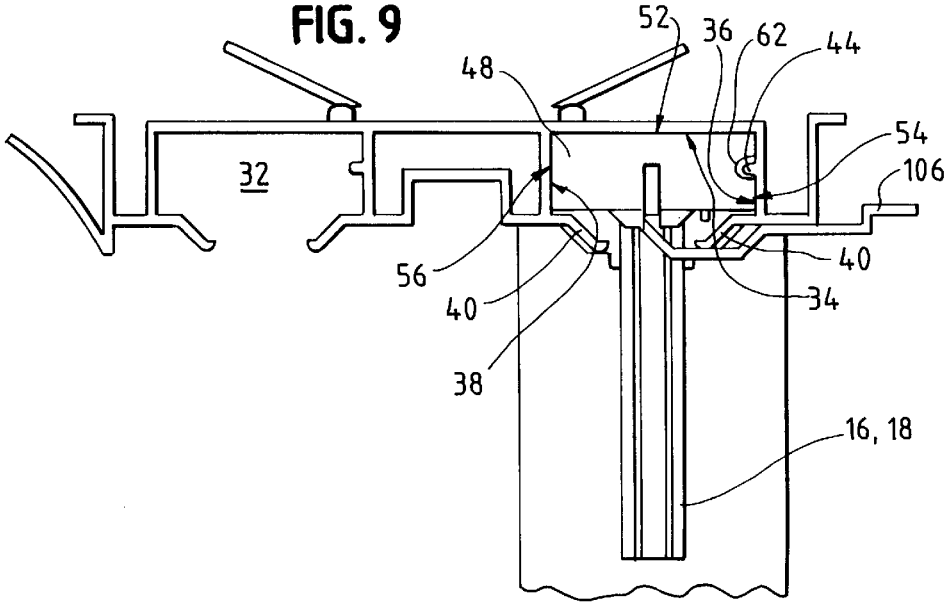
FIG. 9 is a top view of the locking assembly slidably mounted within a slide channel of the jamb liner.
Figure 10:
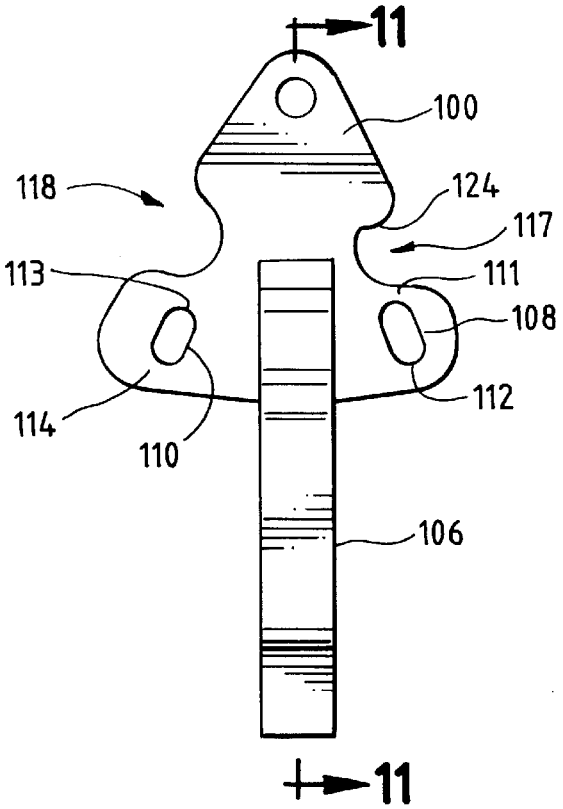
FIG. 10 is a front view of the lock plate and handle of the present invention.
Figure 11:
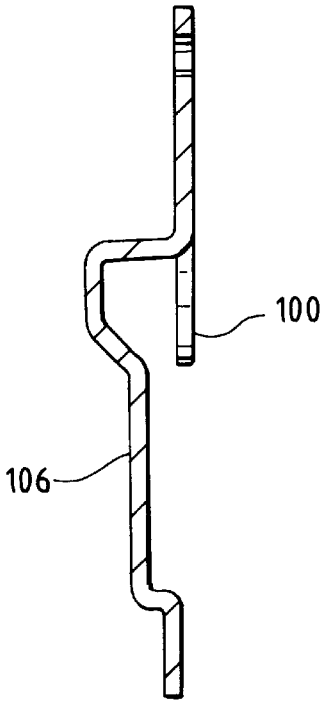
FIG. 11 is a cross-sectional view taken along line 11—11 in FIG. 10.
Figure 12:
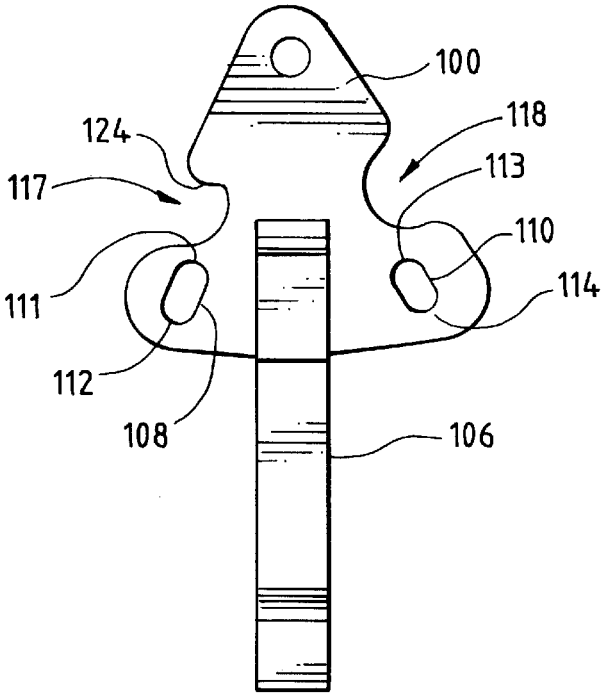
FIG. 12 is a rear view of the lock plate and handle of the present invention.

Pivoting of the lock plate 100 is effectuated by a handle member 106 which is depicted as being integrally formed with the lock plate 100 and extending therefrom toward an interior room area, however, the handle 106 may be separate from and attached to the lock plate 100. The handle 106 and lock plate 100 are shown more particularly in FIGS. 10–12. The handle 106 includes a plurality of bends and, as shown more particularly in FIG. 9, is shaped to generally conform to the exterior surface of the jamb liner 28, thus adding to the visually pleasing and non-obtrusive appearance of the locking assembly 46.

The lock plate 100 includes a pair of elongate slot openings 108, 110 disposed on either side of the handle 106. Each slot opening 108, 110 has a length defined by opposing end walls 111, 112 and 113, 114, respectively. Slot openings 108 and 110 receive corresponding fingers 115 and 116, which extend substantially perpendicularly from side plates 72 and 86 of the first and second locking members 68 and 70, respectively. While the invention, as shown, depicts finger 115 extending from side plate 72 and finger 116 extending from side plate 86, it should be noted that fingers 115 and 116 could also extend from side plates 74 and 88, respectively, with the lock plate 100 mounted on the other side of the shoe 48 for use on the opposite side of the sash 12.

The lock plate 100 also includes recessed portions 117, 118 disposed on opposite sides of the handle 106 for receiving corresponding rivets head 120 and 122 on side plates 72 and 86 during pivotal movement of the lock plate 100. Moreover, recess 117 includes a detent feature which maintains the first and second locking members 68, 70 in either their limiting or releasing positions. This detent feature includes an overcenter curved portion 124 integral with the lock plate 100 which extends into the recess 117. The overcenter curved portion 124 frictionally engages the rivet head 120 of rivet 76 to maintain the first and second locking members 68, 70 in their limiting and/or releasing positions as will be more fully described below.

Operation of the locking assembly 46 will now be described. The shoe 48, as shown more particularly in FIG. 9, is slidably movable within one of the slide channels 30, 32. In this position, the rib 44 extending from the forward wall 36 is received in the groove 62 formed in the side face 54 of the shoe 48. The shoe 48 further includes an opening 126 for connection to one of the pivot pins 16, 18 on the sash 12, through vertical opening 42, for sliding movement therewith, and also includes an opening 128 for connection to a counterbalancing means 130 on the frame 15, the operable connection of openings 126 and 128 being shown more particularly in FIG. 8.

With the first and second locking members 68, 70 in their releasing position, as shown in FIG. 8, the shoe 48 is freely slidably movable within the slide channel 30 in direct relationship to the sliding movement of the sash 12. In this releasing position as shown in FIG. 8, the rivet head 120 is disposed within recess 117 and is held in place by the frictional engagement with the overcenter curved portion 124, and upright fingers 115, 116 are adjacent end walls 112, 113 of slots 108, 110, respectively.

With the locking assembly 46 in its releasing position, the sash 12 is freely movable between its fully opened and closed positions. The locking assembly 46 is repositionable to its limiting position with the sash 12 at any position between, and including, its fully opened and closed positions. Thus, the sash 12 can be placed at a desired open venting position, and the locking assembly 46 can be effectuated to essentially lock the sash 12 in place. Locking is done as follows.

As the handle 106 is pivoted downward, as indicated by arrow 132 in FIG. 8, the upright fingers 115, 116 follow slots 108, 110 during pivoting of the lock plate 100 to pivot the first and second locking members 68, 70 to their limiting position as shown in FIGS. 4–7. More specifically, as the handle 106 is pivoted downward in the direction of arrow 132, the upright fingers 115, 116 move along the elongate slots 108, 110 from end wall 112, 113 to end wall 111, 114, respectively.

In the limiting, or locked, position, the tooth portions 82, 84 and 96, 98 of the first and second locking members 68 and 70 extend forward of shoe side face 54 and engage and grip the forward wall 36 of the jamb liner 28 to lock the window sash 12 in its respective position. The gripping is effected by the teeth 82, 84 and 96, 98 digging into and distorting the forward wall 36 and essentially embedding themselves in the forward wall 36 to prevent against movement of the sash 12 in a raised direction.

The first and second locking members 68, 70 are held in their locked position by the cooperating detent feature of rivet head 120 and the overcenter curved portion 124. As the lock plate 100 is pivoted from its releasing to limiting position, the rivet head 120 travels over the perimeter of the overcenter curved portion 124 and comes to rest outside of recess 117 to frictionally maintain the first and second locking member 68, 70 in their locked position.

In a preferred form, a second shoe is provided which is slidably mountable in a slide channel 30, 32 of the jamb liner 28 opposite the one in which the first shoe 48 is mounted. This second shoe is connected to the other of pivot pins 16, 18 for sliding movement with the sash 12. The second shoe may simply include a single piece formed of a low-friction plastic or other similar material, or may also include the locking assembly 46 as previously described. The inclusion of an additional locking assembly 46 on the second shoe further aids in the prevention of raising and/or lowering the sash 12 with the locking assembly 46 in its limited position.

Thus, the present invention permits a user to lock the window sash 12 in place at an infinite number of open venting positions. With the locking assembly 46 placed in the locked position, the sash 12 is incapable of being raised further due to the gripping action between the teeth 82, 84 and 96, 98 and forward wall 36.

Of course, since the entire locking assembly 46 is disposed along the side of the window sash 12, it presents no intrusion whatsoever to the view through the window. Also, this location of the locking assembly is not readily visible from the outside, and therefore a potential intruder cannot readily see the position of the lock.

While the invention has been shown and described with respect to a specific embodiment thereof, this is for the purpose of illustration rather than limitation and other variations of modifications of the present design herein shown and described will be apparent to those skilled in the art, all within the intended spirit and scope of the invention. Accordingly, the patent is not to be limited in scope and effect to the specific embodiment herein shown and described, nor in any way that is inconsistent with the extent to which the progress in the art has been advanced by the invention.

We claim:

1. In a double-hung window assembly having at least one sash slidably movable in a window frame, the window frame including a pair of vertical jamb liners secured thereto with each jamb liner defining a vertical slide channel having opposing side walls, the one sash in an operable position being substantially vertically oriented with vertically oriented sides substantially adjacent to and oriented parallel with said vertical jamb liners, the window assembly including means connected to the frame for urging the one sash toward a raised position, a locking assembly comprising:

a first shoe received in one slide channel for vertical sliding movement therein and operably connected to the one sash for sliding movement therewith;

means operably connected to the first shoe and selectively engageable with one of the side walls in the one slide channel for limiting sliding movement of the one sash in a raised direction while the one sash is in the operable position; and a handle operably connected to said limiting means and accessible to a user, wherein pivoting the handle selectively moves said limiting means into and out of engagement with said one of said side walls.

2. The locking assembly of claim 1, wherein the limiting means includes a first locking member rotatably connected to the first shoe, and said handle is pivotally connected to the first shoe and operatively engageable with the first locking member for effectuating pivoting movement of the first locking member between (a) a limiting position wherein the first locking member engages the one side wall of the one slide channel and (b) a releasing position wherein the first locking member is disengaged from the one side wall of the one slide channel.

3. The locking assembly of claim 2, wherein the first locking member in its limiting position secures the one sash only against movement in the raised direction.

4. The locking assembly of claim 3, wherein the first locking member is pivotable to its limiting position at an infinite number of positions along the one slide channel.

5. The locking assembly of claim 2, wherein the first locking member includes at least one tooth, wherein the at least one tooth engages and grips the one side wall of the one slide channel with the first locking member in the limiting position.

6. The locking assembly of claim 2, wherein the first locking member includes a pair of side plates rotatably mounted on opposite sides of the first shoe, and a connecting plate connected between the side plates and disposed in a first recess formed in the first shoe, wherein each side plate includes a tooth for engaging and gripping the one side wall of the one slide channel with the first locking member in the limiting position.

7. The locking assembly of claim 1, further comprising:

a pair of pivot shafts secured to opposite sides of the one sash defining a horizontal axis for tilting movement of the one sash relative to the frame; and a second shoe received in the other slide channel for vertical sliding movement therein, the first and second shoes each being connected to the urging means and to one of the pivot shafts.

8. In a double-hung window assembly having at least one sash slidably movable in a window frame, the window frame including a pair of vertical jamb liners secured thereto, with each jamb liner defining a vertical slide channel having opposing side walls, the window assembly including means connected to the frame for urging the one sash toward a raised position, a locking assembly comprising:

a first shoe received in one slide channel for vertical sliding movement therein and operably connected to the one sash for sliding movement therewith;

a first locking member rotatable connected to the first shoe and selectively engageable with one of the side walls in the one slide channel for limiting sliding movement of the one sash in a raised direction, said first locking member including a pair of side plates rotatable mounted on opposite sides of the first shoe, and a connecting plate connected between the side plates and disposed in a first recess formed in the first shoe, wherein each side plate includes a tooth for engaging and gripping the one side wall of the one slide channel with the first locking member in the limiting position;

a lock plate pivotally attached to the first shoe and operatively engageable with the first locking member for effectuating pivoting movement of the first locking member between (a) a limiting position wherein the first locking member engages the one side wall of the one slide channel and (b) a releasing position wherein the first locking member is disengaged from the one side wall of the one slide channel; and a handle extending from the lock plate and accessible to a user, wherein pivoting the handle effects pivotal movement of the first locking member via the lock plate.

9. The locking assembly of claim 8, wherein the lock plate includes a first elongate slot and the first locking member includes a first finger extending from one of the side plates and received in the first elongate slot, wherein pivotal movement of the lock plate causes the first finger to move along the first elongate slot thereby effecting pivoting movement of the first locking member.

10. The locking assembly of claim 9, further including detent means for releasably maintaining the first locking member in at least one of the limiting position and the releasing position.

11. The locking assembly of claim 10, wherein the detent means includes a projection on one of the side plates of the first locking member and a corresponding recess in the lock plate, wherein the projection is releasably frictionally maintained in the recess with the first locking member in one of the limiting position and the releasing position.

12. The locking assembly of claim 11, further comprising a second locking member rotatably mounted to the first shoe and operatively engageable with the lock plate, the second locking member pivotable between limiting and releasing positions in conjunction with the first locking member, the second locking member including a pair of side plates rotatably mounted on opposite sides of the first shoe, and a connecting plate connected between the side plates and disposed in a second recess formed in the first shoe, wherein each side plate includes a tooth which engages and grips one of the side walls of the one slide channel with the second locking member in the limiting position.

13. The locking assembly of claim 12, wherein the lock plate includes a second elongate slot and the second locking member includes a second finger extending from one of the side plates and received in the second elongate slot, wherein pivotal movement of the lock plate causes the second finger to move along the second elongate slot thereby effecting pivotal movement of the second locking member.

14. The locking assembly of claim 13, wherein (a) with the first and second locking members in the limiting position the one sash is restrained from sliding movement in the raised direction and (b) with the first and second locking members in the releasing position sliding movement of the one sash is permitted in both raised and lowered directions.

15. In a window assembly having at least one sash slidably movable in a window frame, the window frame including at least one channel defined in a wall thereof, the one sash in an operable position being substantially vertically oriented with at least one side substantially adjacent to and oriented parallel with said one channel, the one channel having opposing side walls, a locking assembly comprising:

a shoe slidably mounted in the one channel for sliding movement therein and operably connected to the one sash;

at least one locking member operably mounted to the shoe and operable between locked and unlocked positions, wherein with the one locking member in its locked position the one locking member engages one of the opposing channel side walls and limits movement of the one sash in a first direction; and manually actuatable means operably connected to the shoe and operably engageable with the one locking member for shifting the one locking member between its locked and unlocked positions while the sash is in the operable position.

16. The locking assembly of claim 15, wherein the one locking member includes at least one tooth engaging the one side wall of the one channel with the one locking member in the locked position.

17. The locking assembly of claim 16, wherein the one locking member includes a pair of side plates rotatably mounted on opposite sides of the shoe, and a connecting plate connected between the side plates and disposed in a recess formed in the shoe, wherein each side plate includes a tooth engaging the one side wall of the one channel with the one locking member in the locked position.

18. In a window assembly having at least one sash slidably movable in a window frame, the window frame including at least one channel defined in a wall thereof, the one channel having opposing side walls, a locking assembly comprising:

a shoe slidably mounted in the one channel for sliding movement therein and operably connected to the one sash;

at least one locking member operably mounted to the shoe and operable between locked and unlocked positions, said one locking member including at least one tooth engaging the one side wall of the one channel with the one locking member in the locked position to limit movement of the one sash in a first direction, a pair of side plates rotatably mounted on opposite sides of the shoe, and a connecting plate connected between the side plates and disposed in a recess formed in the shoe, wherein each side plate includes a tooth engaging the one side wall of the one channel with the one locking member in the locked position; and a lock plate pivotally attached to the shoe with a handle extending therefrom, the lock plate including an elongate slot having a length defined by opposing end walls and the one locking member including an upright finger extending from one of the side plates and received in the elongate slot, wherein the upright finger follows the slot during pivoting of the lock plate to pivot the one locking member between its locked and unlocked positions.

19. The locking assembly of claim 18, wherein pivotal movement of the lock plate is limited by engagement of the upright finger with the opposing end walls of the elongate slot.

20. The locking assembly of claim 18, further including detent means for releasably maintaining the one locking member in at least one of the locked position and the unlocked position.

21. The locking assembly of claim 20, wherein the detent means includes a projection on one of the side plates of the one locking member and a corresponding recess in the lock plate, wherein the projection is releasably frictionally maintained in the recess with the one locking member in one of the locked position and the unlocked position.

22. In a window assembly having at least one sash slidably movable in a window frame, the window frame including a pair of jamb liners, with each jamb liner defining a channel having opposing side walls, a locking assembly comprising:

at least one shoe slidably mounted in one of the channels and operably connected to the one sash for sliding movement therewith;

first and second locking members rotatably mounted to the one shoe and pivotable between locked and unlocked positions, wherein in the locked position the first and second locking members engage one of the side walls of the one channel to limit sliding movement of the shoe in a first direction; and actuator means operably connected to the one shoe and operably engageable with the first and second locking members for pivoting the first and second locking members between the locked and unlocked positions.

23. The locking assembly of claim 22, wherein the first and second locking members each include at least one tooth engaging and gripping one of the side walls with the first and second locking members in the locked position.

24. The locking assembly of claim 23, wherein the actuator means comprises a lock plate pivotally connected to the one shoe and operatively engageable with the first and second locking members, and a handle operably connected to the lock plate, wherein pivoting the handle effects pivotal movement of the first and second locking members via the lock plate.

25. A locking assembly for use in a double-hung window assembly comprising:

a window frame including a pair of vertical jamb liners secured thereto, with each jamb liner defining a vertical slide channel having opposing side walls;

a window sash with sides slidably mounted between the jamb liners of the window frame, said sash in an operable position being substantially vertically oriented with said sides substantially adjacent to and parallel with said vertical iamb liners;

a shoe received in one of the slide channels for vertical sliding movement therein and operatively connected to the sash for sliding movement therewith; and means operatively connected to the shoe and selectively engageable with one of the side walls in the one slide channel for limiting sliding movement of the sash in a raised direction when the sash is in the operable position.

26. The locking assembly of claim 25, wherein the limiting means includes a locking member rotatably mounted to the shoe and pivotable between limiting and releasing positions, said locking member including at least one tooth, wherein the at least one tooth digs into and distorts the one side wall of the one slide channel with the locking member in the limiting position.

27. The locking assembly of claim 26, wherein the locking member in the limiting position secures the sash only against movement in the raised direction.

28. The locking assembly of claim 26, wherein the pair of vertical jamb liners are plastic jamb liners.

29. The locking assembly of claim 26, wherein the locking member includes a pair of side plates rotatably mounted on opposite sides of the shoe and a connecting plate between the side plates and disposed in a recess formed in the shoe, each side plate including a tooth which digs into and distorts the one side wall of the one slide channel with the locking member in the limiting position.

* * * * *